US005295305A

United States Patent [19]

Hahn et al.

[11] Patent Number: 5,295,305

[45] Date of Patent: Mar. 22, 1994

[54] RAZOR BLADE TECHNOLOGY

[75] Inventors: Steve S. Hahn, Wellesley Hills; John Madeira, Assonet, both of Mass.

[73] Assignee: The Gillette Company, Boston, Mass.

[21] Appl. No.: 8,396

[22] Filed: Jan. 25, 1993

Related U.S. Application Data

[63] Continuation of Ser. No. 835,251, Feb. 13, 1992, abandoned.

[51] Int. Cl.[5] ..... B26B 21/00; B26B 21/54

[52] U.S. Cl. ..... 30/50; 30/346.53; 30/346.55

[58] Field of Search ..... 30/50, 346, 346.5, 346.53, 30/346.54, 346.55, 346.58, 346.59; 202/192.1

[56] References Cited

U.S. PATENT DOCUMENTS

| | | | |
|---|---|---|---|
| 3,349,488 | 10/1967 | Craig | 30/346.53 |
| 3,480,483 | 11/1969 | Wilkinson | 30/346.53 |
| 3,652,443 | 3/1972 | Fish . | |
| 3,761,372 | 9/1973 | Sastri . | |
| 3,761,373 | 9/1973 | Sastri | 30/346.55 |
| 3,761,374 | 9/1973 | Bromer et al. | 30/346.55 |
| 3,774,703 | 11/1973 | Sanderson . | |
| 3,802,078 | 4/1974 | Denes | 30/346.53 |
| 3,829,969 | 8/1974 | Fischbein . | |
| 3,900,636 | 8/1975 | Curry . | |
| 3,916,523 | 11/1975 | Lane et al. | 30/346.53 |
| 3,961,103 | 6/1976 | Aisenberg . | |
| 4,122,603 | 10/1978 | Sastri | 30/346.53 |
| 4,291,463 | 9/1981 | Williams | 30/346.53 |
| 4,416,912 | 11/1983 | Bache . | |
| 4,434,188 | 2/1984 | Kamo . | |
| 4,453,987 | 6/1984 | Arai et al. | 30/346.53 |
| 4,490,229 | 12/1984 | Mirtich . | |
| 4,504,519 | 3/1985 | Zelez . | |
| 4,720,918 | 1/1988 | Curry . | |
| 4,816,286 | 3/1989 | Hirose . | |
| 4,816,291 | 3/1989 | Desphandey . | |
| 4,822,466 | 4/1989 | Rabalais . | |
| 4,849,290 | 7/1989 | Fujimori . | |
| 4,902,535 | 2/1990 | Garg . | |
| 4,933,058 | 6/1990 | Bache . | |
| 5,067,238 | 11/1991 | Miller et al. | 30/50 |

FOREIGN PATENT DOCUMENTS

WO/9003455 4/1990 PCT Int'l Appl. .

OTHER PUBLICATIONS

Knight et al., "Characterization of diamond films by Raman spectroscopy", J. Mater. Res., vol. 4, No. 2, Mar./Apr. 1989.

*Primary Examiner*—Richard K. Seidel
*Assistant Examiner*—Paul M. Heyrana
*Attorney, Agent, or Firm*—Fish & Richardson

[57] ABSTRACT

A razor blade includes a substrate with a wedge-shaped edge, an interlayer of material selected from the group consisting of silicon, silicon carbide, vanadium, tantalum, nickel, niobium, and niobium-molybdenum alloy and alloys of such materials on the tip and flanks of the wedge-shaped edge, the thickness of the interlayer preferably being in the range of about 50–500 angstroms, and a layer of diamond or diamond-like carbon material on the interlayer that preferably has a thickness of about two thousand angstroms and that defines a tip radius of less than about 1000 angstroms.

24 Claims, 1 Drawing Sheet

RAZOR BLADE TECHNOLOGY

This is a continuation of application Ser. No. 07/835,251, filed Feb. 13, 1992, now abandoned.

RAZOR BLADE TECHNOLOGY

This invention relates to improved razors and razor blades and to processes for producing razor blades or similar cutting tools with sharp and durable cutting edges.

A razor blade typically is formed of suitable substrate material such as metal or ceramic and an edge is formed with wedge-shape configuration with an ultimate edge or tip that has a radius of less than about 1,000 angstroms, the wedge shaped surfaces having an included angle of less than 30°. As shaving action is severe and blade edge damage frequently results and to enhance shavability, the use of one or more layers of supplemental coating material has been proposed for shave facilitation, and/or to increase the hardness and/or corrosion resistance of the shaving edge. A number of such coating materials have been proposed, such as polymeric materials and metals, as well as other materials including diamond and diamond-like carbon (DLC) material. Each such layer or layers of supplemental material must have adhesion compatibility so that each layer remains firmly adhered to the substrate throughout the useful life of the razor blade, and desirably provide characteristics such as improved shavability, improved hardness and/or corrosion resistance while not adversely affecting the geometry and cutting effectiveness of the shaving edge. It has been proposed to provide the cutting edges of razor blades with improved mechanical properties by applying to the sharpened edge of the substrate a coating of diamond or diamond-like carbon (DLC) material. Such materials may be characterized as having substantial sp3 carbon bonding; a mass density greater than 1.5 grams/cm$^3$; and a Raman peak at about 1331 cm$^{-1}$ (diamond) or about 1552 cm$^{-1}$ (DLC). However, it has been found that under certain accelerated corrosion testing conditions such as immersion in hot distilled water at 80° C. for 16 hours, a diamond-like carbon coating can delaminate from a molybdenum interlayer and the steel blade substrate by what appears to be an electrochemical reaction.

In accordance with one aspect of the invention, there is provided a razor blade comprising a substrate with a wedge-shaped edge, an interlayer of material selected from the group consisting of silicon, silicon carbide, vanadium, tantalum, nickel, niobium, and niobium-molybdenum alloy and alloys of such materials on the tip and flanks of the wedge-shaped edge, the thickness of the interlayer preferably being in the range of about 50–500 angstroms, and a layer of diamond or diamond-like carbon material on the interlayer that preferably has a thickness of at least about 1200 angstroms, defines a tip radius of less than about 400 angstroms and an aspect ratio in the range of 1:1–3:1. The blade exhibits excellent shaving properties and long shaving life.

In particular embodiments, the razor blade substrate is steel; the diamond or DLC coating is at least twice as hard as the metal substrate; the wedge-shaped edge is formed by a sequence of mechanical abrading steps; and the layers of interlayer material (a preferred material being niobium) and diamond or diamond-like carbon material are formed by sputtering material from targets of the interlayer material and graphite.

In accordance with another aspect of the invention, there is provided a process for forming a razor blade that includes the steps of providing a substrate, forming on an edge of the substrate a wedge-shaped sharpened edge that has an included angle of less than 30° and a tip radius (i.e. the estimated radius of the larger circle that may be positioned within the ultimate tip of the edge when such ultimate tip is viewed under a scanning electron microscope at magnifications of at least 25,000) preferably of less than 1,200 angstroms; depositing a layer of interlayer material selected from the group consisting of silicon, silicon carbide, vanadium, tantalum, nickel, niobium, and niobium-molybdenum alloy and alloys of such materials on the sharpened edge; and depositing a layer of diamond or diamond-like material on the interlayer to provide a radius at the ultimate tip of the diamond or diamond-like carbon material of less than about 1,000 angstroms.

The interlayer and the diamond or DLC layer may be deposited by various techniques such as plasma decomposition of hydrocarbon gases, sputter deposition using ions from either a plasma or an ion gun to bombard a target, directly using a beam of carbon ions, and ion beam assisted deposition (IBAD) process using either E-Beam or sputtering sources.

In a particular process, the substrate is mechanically abraded in a sequence of honing steps to form the sharpened edge; layers of niobium and diamond or diamond-like carbon material are successively deposited by sputtering; the niobium interlayer having a thickness of less than about five hundred angstroms, and the diamond or DLC coating on the niobium coated cutting edge having a thickness of at least about twelve hundred angstroms; the layer of diamond having a Raman peak at about 1331 cm$^{-1}$ and the layer of diamond-like carbon (DLC) material having a Raman peak at about 1550 cm$^{-1}$; substantial sp3 carbon bonding; and a mass density greater than 1.5 grams/cm$^3$; and an adherent polymer coating is applied on the diamond or DLC coated cutting edge.

In accordance with another aspect of the invention, there is provided a shaving unit that comprises blade support structure that has external surfaces for engaging user skin ahead and rearwardly of the blade edge or edges and at least one blade member secured to the support structure. The razor blade structure secured to the support structure includes a substrate with a wedge-shaped cutting edge defined by facets that have an included angle of less than seventeen degrees at a distance of forty micrometers from the sharpened tip, an interlayer selected from the group consisting of silicon, silicon carbide, vanadium, tantalum, nickel, niobium, and niobium-molybdenum alloy and alloys of such materials and a layer of strengthening material on the interlayer that has a thickness of at least twelve hundred angstroms from the sharpened tip of said substrate to a distance of forty micrometers from the sharpened tip, and an ultimate tip defined by facets that have lengths of at least about 0.1 micrometer and define an included angle of at least sixty degrees, a radius at the ultimate tip of the strengthening material of less than 400 angstroms and an aspect ratio in the range of 1:1–3:1.

In a particular shaving unit, the razor blade structure includes two steel substrates, the wedge-shaped edges are disposed parallel to one another between the skin-engaging surfaces; a niobium interlayer is between the steel substrate and the edge strengthening layer and the edge strengthening layer is of diamond or DLC material; each niobium layer has a thickness of less than about five hundred angstroms; each diamond or DLC coating has a thickness of about two thousand angstroms (typically a range of 1800–2200 angstroms depending on processing parameters) and is characterized by substantial sp3 carbon bonding; a mass density greater than 1.5 grams/$cm^3$; and a Raman peak at about 1331 $cm^{-1}$ (diamond) or about 1550 $cm^{-1}$ (DLC); and an adherent polymer coating is on each layer of diamond or diamond-like carbon material.

The shaving unit may be of the disposable cartridge type adapted for coupling to and uncoupling from a razor handle or may be integral with a handle so that the complete razor is discarded as a unit when the blade or blades become dull. The front and rear skin engaging surfaces cooperate with the blade edge (or edges) to define the shaving geometry. Particularly preferred shaving units are of the types shown in U.S. Pat. No. 3,876,563 and in U.S. Pat. No. 4,586,255.

Other features and advantages of the invention will be seen as the following description of particular embodiments progresses, in conjunction with the drawings, in which.

Description of Particular Embodiments

Figure 1:
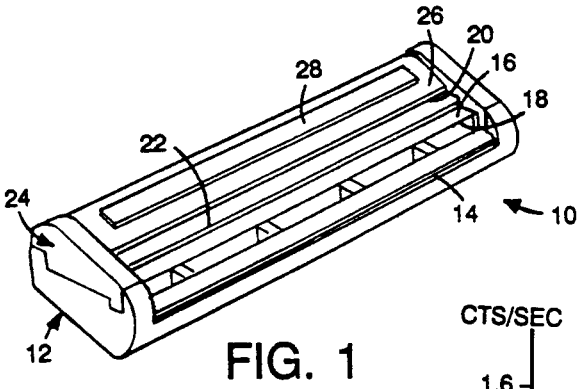
FIG. 1 is a perspective view of a shaving unit in accordance with the invention.
Figure 5:
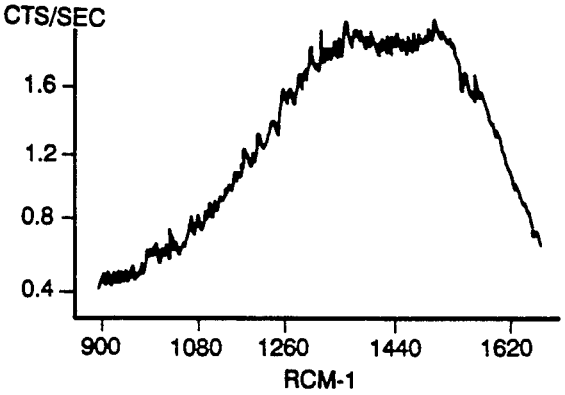
FIG. 5 is a Raman spectrum of DLC material deposited with the apparatus of FIG. 4.

With reference to FIG. 1, shaving unit 10 includes structure for attachment to a razor handle, and a platform member 12 molded of high-impact polystyrene that includes structure defining forward, transversely-extending skin engaging surface 14. Mounted on platform member 12 are leading blade 16 having sharpened edge 18 and following blade 20 having sharpened edge 22. Cap member 24 of molded high-impact polystyrene has structure defining skin-engaging surface 26 that is disposed rearwardly of blade edge 22, and affixed to cap member 24 is shaving aid composite 28.

Figure 2:
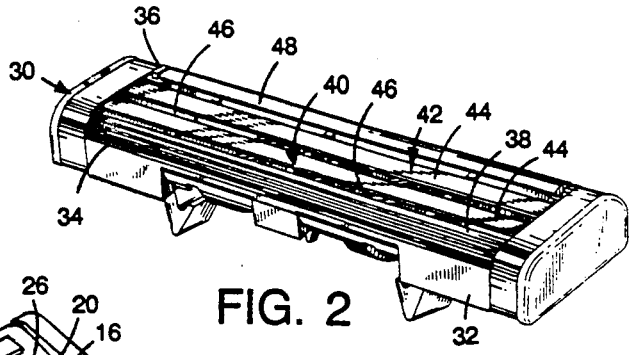
FIG. 2 is a perspective view of another shaving unit in accordance with the invention.

The shaving unit 30 shown in FIG. 2 is of the type shown in Jacobson U.S. Pat. No. 4,586,255 and includes molded body 32 with front portion 34 and rear portion 36. Resiliently secured in body 32 are guard member 38, leading blade unit 40 and trailing blade unit 42. Each blade unit 40, 42 includes a blade member 44 that has a sharpened edge 46. A shaving aid composite 48 is frictionally secured in a recess in rear portion 36.

Figure 3:
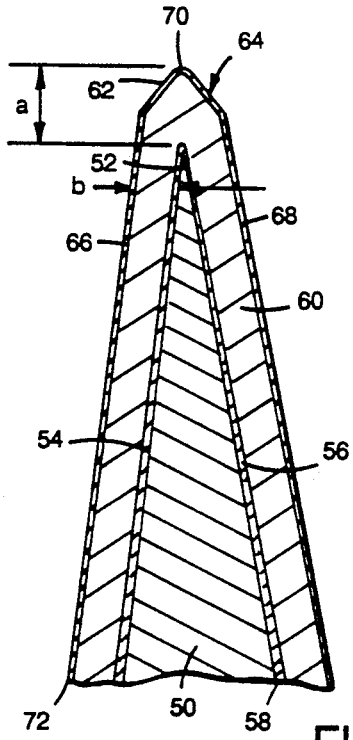
FIG. 3 is a diagrammatic view illustrating one example of razor blade edge geometry in accordance with the invention.

A diagrammatic view of the edge region of the blades 16, 20 and 44 is shown in FIG. 3. The blade includes stainless steel body portion 50 with a wedge-shaped sharpened edge formed in a sequence of edge forming honing operations that forms a tip portion 52 that has a radius typically less than 500 angstroms with facets 54 and 56 that diverge at an angle of about 13°. Deposited on tip 52 and facets 54, 56 is interlayer 58 of niobium that has a thickness of about 300 angstroms. Deposited on niobium interlayer 58 is outer layer 60 of diamond-like carbon (DLC) that has a thickness of about 2,000 angstroms, with facets 62, 64 that have lengths of about one-quarter micrometer each and define an included angle of about 80°, facets 62, 64 merging with main facet surfaces 66, 68 that are disposed at an included angle of about 13° and an aspect ratio (the ratio of the distance (a) from DLC tip 70 to stainless steel tip 52 and the width (b) of the DLC coating 60 at tip 52) of about 1.7. Deposited on layer 60 is an adherent telomer layer 72 that has a substantial as deposited thickness but is reduced to monolayer thickness during initial shaving.

Figure 4:
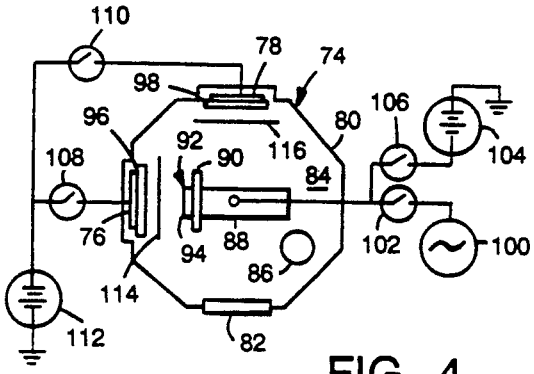
FIG. 4 is a diagrammatic view of apparatus for the practice of the invention.

Apparatus for processing blades of the type shown in FIG. 3 is diagrammatically illustrated in FIG. 4. That apparatus includes a DC planar magnetron sputtering system manufactured by Vac Tec Systems of Boulder, Colorado that has stainless steel chamber 74 with wall structure 80, door 82 and base structure 84 in which is formed port 86 coupled to a suitable vacuum system (not shown). Mounted in chamber 74 is carousel support 88 with upstanding support member 90 on which is disposed a stack of razor blades 92 with their sharpened edges 94 in alignment and facing outwardly from support 90. Also disposed in chamber 74 are support structure 76 for target member 96 of niobium (99.99% pure) and support structure 78 for target member 98 of graphite (99.999% pure). Targets 96 and 98 are vertically disposed plates, each about twelve centimeters wide and about thirty-seven centimeters long. Support structures 76, 78 and 88 are electrically isolated from chamber 74 and electrical connections are provided to connect blade stack 92 to RF power supply 100 through switch 102 and to DC power supply 104 through switch 106; and targets 96 and 98 are connected through switches 108, 110, respectively, to DC magnetron power supply 112. Shutter structures 114 and 116 are disposed adjacent targets 96, 98, respectively, for movement between an open position and a position obscuring its adjacent target.

Carousel 88 supports the blade stack 92 with the blade edges 94 spaced about seven centimeters from the opposed target plate 96, 98 and is rotatable about a vertical axis between a first position in which blade stack 92 is in opposed alignment with niobium target 96 (FIG. 4) and a second position in which blade stack 92 is in opposed alignment with graphite target 98.

In a particular processing sequence, a stack of blades 92 (five centimeters high) is secured on support 90; chamber 74 is evacuated; the targets 96, 98 are cleaned by DC sputtering for five minutes; switch 102 is then closed and the blades 92 are RF cleaned in an argon environment for five minutes at a pressure of ten millitorr, an argon flow of 200 sccm and a power of 1.5 kilowatts; the argon flow is then reduced to 150 sccm at a pressure of 2.0 millitorr in chamber 74; switch 106 is closed to apply a DC bias of −25 volts on blades 92; switch 108 is closed to commence sputtering at one kilowatt power and shutter 114 in front of niobium target 96 is opened for thirty seconds to deposit a niobium layer 58 of about 300 angstroms thickness on the blade edges 94. Shutter 114 is then closed, switches 106 and 108 are opened, and carousel 88 is rotated 90° to juxtapose the blade edges of blade stack 92 with graphite target 98. Pressure in chamber 74 is maintained at two millitorr with an argon flow of 150 sccm; switch 110 is closed to sputter graphite target 98 at 750 watts; switch 102 is closed to apply a 13.56 MHz RF bias of eight hundred watts (−420 volts DC self bias voltage) on blades 92, and concurrently shutter 116 is opened for twenty minutes to deposit a DLC layer 60 of about two thousand angstroms thickness on niobium layer 58. The DLC coating 60 had a radius at tip 70 of about 350

Angstroms that is defined by facets 62, 64 that have an included angle of about 80°, and an aspect ratio of about 1.9:1.

A coating 72 of polytetrafluoroethylene telomer is then applied to the DLC-coated edges of the blades. The process involves heating the blades in a neutral atmosphere of argon and providing on the cutting edges of the blades an adherent and friction-reducing polymer coating of solid PTFE. Coatings 58 and 60 were firmly adherent to the blade body 50, provided low wet wool felt cutter force (the lowest of the first five cuts with wet wool felt (L5) being about 0.45 kilogram), and withstood repeated applications of wool felt cutter forces indicating that the DLC coating 60 is substantially unaffected by exposure to the severe conditions of this felt cutter test and remains firmly adhered to the blade body 50, even after immersion in 80° C. distilled water for sixteen hours. Resulting blade elements 44 were assembled in cartridge units 30 of the type shown in FIG. 2 and shaved with excellent shaving results.

While a particular embodiment of the invention has been shown and described, various modifications will be apparent to those skilled in the art, and therefore, it is not intended that the invention be limited to the disclosed embodiment, or to details thereof, and departures may be made therefrom within the spirit and scope of the invention.

What is claimed is:

1. A process for forming a razor blade comprising the steps of providing a substrate, forming a wedge-shaped sharpened edge on said substrate that has an included angle of less than thirty degrees and a tip radius of less than twelve hundred angstroms;

depositing an interlayer of material selected from the group consisting of silicon, silicon carbide, vanadium, tantalum, niobium, and niobium-molybdenum alloy and alloys of such materials on said sharpened edge; and depositing a layer of diamond or diamond-like carbon (DLC) material on said interlayer.

2. The process of claim 1 wherein said substrate is mechanically abraded in a sequence of honing steps to form said sharpened edge.

3. The process of claim 1 and further including the step of applying an adherent polymer coating on said diamond or DLC coated cutting edge.

4. The process of claim 1 wherein said interlayer on said cutting edge has a thickness of less than about five hundred angstroms, and said diamond or DLC coating on said interlayer coated cutting edge has a thickness of, at least twelve hundred angstroms from the sharpened tip of said substrate to a distance of forty micrometers from the sharpened tip.

5. The process of claim 1 wherein said substrate is of metal and said diamond or DLC coating is at least twice as hard as said metal substrate.

6. The process of claim 1 wherein said layer of diamond or DLC carbon material is deposited by a technique selected from the group consisting of plasma decomposition of hydrocarbon gases, sputter deposition using ions from either a plasma or an ion gun to bombard a graphite target, directly using a beam of carbon ions, and an ion beam assisted deposition (IBAD) process using either E-Beam or sputtering sources.

7. The process of claim 1 wherein said layer of diamond or diamond-like carbon material is deposited in an argon atmosphere in an evacuated chamber in which a graphite target and a shutter are located; said graphite target is energized; and said shutter is opened to deposit said layer of diamond or diamond-like carbon material on said sharpened edge while an RF bias is applied to said substrate.

8. The process of claim 7 and further including a niobium target in said chamber, and an interlayer of niobium is deposited on said blade edge by sputtering.

9. A process for forming a razor blade comprising the steps of providing a substrate, forming on said substrate a wedge-shaped edge that has an included angle of less than 30° and a tip radius less than 1,200 angstroms; depositing an interlayer of material selected from the group consisting of silicon, silicon carbide, vanadium, tantalum, niobium, and niobium-molybdenum alloy and alloys of such materials on said wedge-shaped edge; and depositing a layer of diamond or diamond-like carbon (DLC) material on said interlayer to provide a radius at the ultimate tip of said diamond or diamond-like carbon material of less than 1,200 angstroms.

10. The process of claim 9 wherein said interlayer and said diamond or diamond-like carbon material are deposited by sputtering.

11. The process of claim 9 wherein said interlayer on said wedge-shaped edge has a thickness of less than about five hundred angstroms, and said diamond or DLC coating on said interlayer cutting edge has a thickness of at least about twelve hundred angstroms.

12. The process of claim 11 and further including the step of applying an adherent polymer coating on said diamond or DLC coated cutting edge.

13. The process of claim 12 wherein said diamond or DLC coating on said cutting edge has a thickness of about two thousand angstroms.

14. A razor blade comprising a substrate with a wedge-shaped edge defined by facets that have a width of at least about 0.1 millimeter and an included angle of less than thirty degrees, an interlayer of material selected from the group consisting of silicon, silicon carbide, vanadium, tantalum, niobium, and niobium-molybdenum alloy and alloys of such materials on said wedge-shaped edge; and a layer of diamond or diamond-like carbon material on said interlayer.

15. The razor blade of claim 14 wherein said layer of diamond or diamond-like carbon (DLC) material has a Raman peak at about 1331 $cm^{-1}$ (diamond) or about 1552 $cm^{-1}$ (DLC).

16. The razor blade of claim 15 wherein said layer of diamond or diamond-like carbon (DLC) has an aspect ratio of less than about 3:1; substantial sp3 carbon bonding; and a mass density greater than 1.5 grams/$cm^3$.

17. The razor blade of claim 16 and further including an adherent polymer coating on said layer of diamond or diamond-like carbon material.

18. The razor blade of claim 17 wherein said interlayer is of niobium and has a thickness of less than about five hundred angstroms, and said diamond or DLC coating on said interlayer has a thickness of about two thousand angstroms.

19. A razor blade comprising a substrate with a wedge-shaped edge, an interlayer of material selected from the group consisting of silicon, silicon carbide, vanadium, tantalum, niobium, and niobium-molybdenum alloy and alloys of such materials on the tip and flanks of said wedge-shaped edge, the thickness of said interlayer being in the range of about 50–500 angstroms, and a layer of diamond or diamond-like carbon material on said interlayer, said layer of diamond or diamond-like carbon material having a thickness of at least about twelve hundred angstroms from the sharpened tip of said substrate to a distance of forty micrometers from the sharpened tip and defining a tip radius of less than about 1000 angstroms.

20. The razor blade of claim 19 wherein said substrate is steel; said wedge-shaped edge is formed by a sequence of mechanical abrading steps; said interlayer is of niobium; and said interlayer and diamond or diamond-like carbon material are formed by sputtering.

21. The razor blade of claim 20 wherein said layer of diamond or diamond-like carbon (DLC) material has substantial sp3 carbon bonding; a mass density greater than 1.5 grams/$cm^3$; and a Raman peak at about 1331 $cm^{-1}$ diamond or about 1552 $cm^{-1}$ (DLC); and further including an adherent polymer coating on said layer of diamond or diamond-like carbon material.

22. A shaving unit comprising support structure that defines spaced skin-engaging surfaces, and razor blade structure secured to said support structure, said razor blade structure including a substrate with a wedge-shaped edge, an interlayer of material selected from the group consisting of silicon, silicon carbide, vanadium, tantalum, niobium, and niobium-molybdenum alloy and alloys of such materials on said wedge-shaped edge; and a layer of diamond or diamond-like carbon material on said interlayer, said diamond or diamond-like carbon coated wedge-shaped edge being disposed between said skin-engaging surfaces.

23. The shaving unit of claim 22 wherein said razor blade structure includes two substrates, and said coated wedge-shaped edges are disposed parallel to one another between said skin-engaging surfaces.

24. The shaving unit of claim 23 wherein each said layer of diamond or diamond-like carbon material has substantial sp3 carbon bonding; a mass density greater than 1.5 grams/$cm^3$; and a Raman peak at about 1331 $cm^{-1}$ (diamond) or 1552 $cm^{-1}$ (DLC); each said interlayer has a thickness of less than five hundred angstroms; and each said diamond or DLC coating on said interlayer has a thickness of about two thousand angstroms; and further including an adherent polymer coating on each said layer of diamond or diamond-like carbon material.

* * * * *

UNITED STATES PATENT AND TRADEMARK OFFICE

CERTIFICATE OF CORRECTION

PATENT NO. : 5,295,305

DATED : March 22, 1994

INVENTOR(S) : Steve S. Hahn, John Madeira, and James A. Ruth, Jr.

It is certified that error appears in the above-identified patent and that said Letters Patent is hereby corrected as shown below:

TITLE PAGE:

Under section [75] Inventors, after "Assonet" delete ", both of Mass." and insert --; James A. Ruth, Jr., Randolph, all of Mass.--.

Signed and Sealed this

Third Day of October, 1995

*Attest:*

Bruce Lehman

BRUCE LEHMAN

*Attesting Officer*

*Commissioner of Patents and Trademarks*

US005295305B1

REEXAMINATION CERTIFICATE (2972th)

United States Patent [19] [11] B1 5,295,305

Hahn et al. [45] Certificate Issued Aug. 13, 1996

[54] RAZOR BLADE TECHNOLOGY

[75] Inventors: Steve S. Hahn, Wellesley Hills; John Madeira, Assonet; James A. Ruth, Jr., Randolph, all of Mass.

[73] Assignee: The Gillette Company, Boston, Mass.

Reexamination Request:
No. 90/003,825, May 9, 1995

Reexamination Certificate for:

| | |
|---|---|
| Patent No.: | **5,295,305** |
| Issued: | **Mar. 22, 1994** |
| Appl. No.: | **8,396** |
| Filed: | **Jan. 25, 1993** |

Certificate of Correction issued Oct. 3, 1995.

Related U.S. Application Data

[63] Continuation of Ser. No. 835,251, Feb. 13, 1992, abandoned.

[51] Int. Cl.[6] ..... B26B 21/54

[52] U.S. Cl. ..... 30/50; 30/346.53; 30/346.55

[58] Field of Search ..... 30/346.53, 346.54, 30/346.55, 350, 50; 427/27; 204/192.3, 192.15, 192.16; 76/104.1, 116, DIG. 8

[56] References Cited

U.S. PATENT DOCUMENTS 5,142,785 9/1992 Grewal et al. .
5,232,568 8/1993 Parent et al. .

FOREIGN PATENT DOCUMENTS

3047888A1 7/1982 Germany .

*Primary Examiner*—Huli-Sui Payer

[57] ABSTRACT

A razor blade includes a substrate with a wedge-shaped edge, an interlayer of material selected from the group consisting of silicon, silicon carbide, vanadium, tantalum, nickel, niobium, and niobium-molybdenum alloy and alloys of such materials on the tip and flanks of the wedge-shaped edge, the thickness of the interlayer preferably being in the range of about 50–500 angstroms, and a layer of diamond or diamond-like carbon material on the interlayer that preferably has a thickness of about two thousands angstroms and that defines a tip radius of less than about 1000 angstroms.

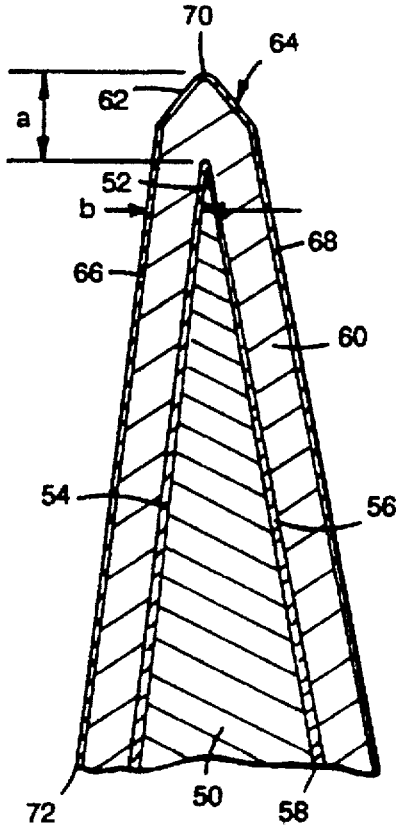

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 9, 14, 19 and 22 are determined to be patentable as amended.

Claims 2–8, 10–13, 15–18, 20, 21, 23 and 24, dependent on an amended claim, are determined to be patentable.

New claims 25–44 are added and determined to be patentable.

1. A process for forming a razor blade comprising the steps of providing a substrate, forming a wedge-shaped sharpened edge on said substrate that has an included angle of less than thirty degrees and a trip radius of less than twelve hundred angstroms; depositing an interlayer of material selected from the group consisting of [silicon,] silicon carbide, vanadium, tantalum, niobium, and niobium-molybdenum alloy and alloys of such materials on said sharpened edge; and depositing a layer of diamond or diamond-like carbon (DLC) material on said interlayer.

9. A process for forming a razor blade comprising the steps of providing a substrate, forming on said substrate a wedge-shaped sharpened edge that has an included angle of less than 30° and a tip radius of less than 1,200 angstroms; depositing an interlayer of material selected from the group consisting of [silicon,] silicon carbide, vanadium, tantalum, niobium, and niobium-molybdenum alloy and alloys of such materials on said wedge-shaped edge; and depositing a layer of diamond or diamond-like carbon (DLC) material on said interlayer to provide a radius at the ultimate tip of said diamond or diamond-like carbon material of less than 1,200 angstroms.

14. A razor blade comprising a substrate with a wedge-shaped edge defined by facets that have a width of at least about 0.1 millimeter and an included angle of less than thirty degrees, an interlayer of material selected from the group consisting of [silicon,] silicon carbide, vanadium, tantalum, niobium, and niobium-molybdenum alloy and alloys of such materials on said wedge-shaped edge; and a layer of diamond or diamond-like carbon material on said interlayer.

19. A razor blade comprising a substrate with a wedge-shaped edge, an interlayer of material selected from the group consisting of [silicon] silicon carbide vanadium, tantalum, niobium, and niobium-molybdenum alloy and alloys of such materials on the tip and flanks of said wedge-shaped edge, the thickness of said interlayer being in the range of about 50–500 angstroms, and a layer of diamond or diamond-like carbon material on said interlayer, said layer of diamond or diamond-like carbon material having a thickness of at least about twelve hundred angstroms from the sharpened tip of said substrate to a distance of forty micrometers from the sharpened tip and defining a tip radius of less than about 1000 angstroms.

22. A shaving unit comprising support structure that defines spaced skin-engaging surfaces, and razor blade structure secured to said support structure, said razor blade structure including a substrate with a wedge-shaped edge, an interlayer of material selected from the group consisting of [silicon,] silicon carbide, vanadium, tantalum, niobium, and niobium-molybdenum alloy and alloys of such materials on said wedge-shaped edge; and a layer of diamond or diamond-like carbon material on said interlayer, said diamond or diamond-like carbon coated wedge-shaped edge being disposed between said skin-engaging surfaces.

*25. The process of claim 1 wherein said interlayer material is silicon carbide.*

*26. The process of claim 1 wherein said interlayer material is vanadium.*

*27. The process of claim 1 wherein said interlayer material is tantalum.*

*28. The process of claim 1 wherein said interlayer material is niobium.*

*29. The process of claim 1 wherein said interlayer material is niobium-molybdenum alloy.*

*30. The razor blade of claim 14 wherein said interlayer material is silicon carbide.*

*31. The razor blade of claim 14 wherein said interlayer material is vanadium.*

*32. The razor blade of claim 14 wherein said interlayer material is tantalum.*

*33. The razor blade of claim 14 wherein said interlayer material is niobium.*

*34. The razor blade of claim 14 wherein said interlayer material is niobium-molybdenum alloy.*

*35. The razor blade of claim 19 wherein said interlayer material is silicon carbide.*

*36. The razor blade of claim 19 wherein said interlayer material is vanadium.*

*37. The razor blade of claim 19 wherein said interlayer material is tantalum.*

*38. The razor blade of claim 19 wherein said interlayer material is niobium.*

*39. The razor blade of claim 19 wherein said interlayer material is niobium-molybdenum alloy.*

*40. The shaving unit of claim 22 wherein said interlayer material is silicon carbide.*

*41. The shaving unit of claim 22 wherein said interlayer material is vanadium.*

*42. The shaving unit of claim 22 wherein said interlayer material is tantalum.*

*43. The shaving unit of claim 22 wherein said interlayer material is niobium.*

*44. The shaving unit of claim 22 wherein said interlayer material is niobium-molybdenum alloy.*

* * * * *